US010720317B2

(12) United States Patent
Wilton

(10) Patent No.: US 10,720,317 B2
(45) **Date of Patent: *Jul. 21, 2020**

(54) APPARATUS FOR MASS ANALYSIS OF ANALYTES BY SIMULTANEOUS POSITIVE AND NEGATIVE IONIZATION

(71) Applicant: MERIDION, LLC, Somerville, MA (US)

(72) Inventor: Nicholas Wilton, Somerville, MA (US)

(73) Assignee: MERIDION, LLC, Sommerville, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/214,566

(22) Filed: Dec. 10, 2018

(65) Prior Publication Data

US 2019/0115201 A1 Apr. 18, 2019

Related U.S. Application Data

(63) Continuation of application No. 15/560,386, filed as application No. PCT/US2016/024757 on Mar. 29, 2016, now Pat. No. 10,153,150.

(Continued)

(51) Int. Cl.
*H01J 49/28* (2006.01)
*H01J 49/14* (2006.01)

(Continued)

(52) U.S. Cl.
CPC ..... *H01J 49/286* (2013.01); *H01J 49/0027* (2013.01); *H01J 49/0422* (2013.01);

(Continued)

(58) Field of Classification Search
CPC .. H01J 49/286; H01J 49/0027; H01J 49/0422; H01J 49/147; H01J 49/22; H01J 49/328

(Continued)

(56) References Cited

U.S. PATENT DOCUMENTS 5,340,983 A 8/1994 Deinzer et al.
10,153,150 B2 * 12/2018 Wilton ..... H01J 49/147

(Continued)

FOREIGN PATENT DOCUMENTS

WO 03/103007 A1 12/2003

OTHER PUBLICATIONS

International Preliminary Report on Patentability for International Application No. PCT/US2016/024757, dated Oct. 12, 2017. (8 pages).

(Continued)

*Primary Examiner* — Nicole M Ippolito
*Assistant Examiner* — Hanway Chang
(74) *Attorney, Agent, or Firm* — Kilpatrick Townsend & Stockton LLP

(57) ABSTRACT

Among other things, we describe methods and apparatus for the ionization of target molecular analytes of interest, e.g., for use in mass spectrometry. In some implementations, a thin molecular stream is emitted in either single or a split mode and encounters both an electron-impact ion source and trochoidal electron monochromator placed sequentially or coincidentally. The first ion source emits high-energy electrons (~70 eV) to generate characteristic positively-charged mass fragment spectra while the second source emits low-energy electrons in a narrow bandwidth to generate negative molecular ions or other ions via electron capture ionization. The dual ion source may be coupled to analytical instruments such as a gas chromatograph and to any number of mass analyzers such as a polarity switching quadrupole mass analyzer or to multiple mass analyzers.

15 Claims, 4 Drawing Sheets

Related U.S. Application Data

(60) Provisional application No. 62/139,758, filed on Mar. 29, 2015.

(51) Int. Cl.

| | |
|---|---|
| ***H01J 49/00*** | (2006.01) |
| ***H01J 49/04*** | (2006.01) |
| ***H01J 49/22*** | (2006.01) |
| ***H01J 49/32*** | (2006.01) |

(52) U.S. Cl.
CPC ..... *H01J 49/147* (2013.01); *H01J 49/22* (2013.01); *H01J 49/328* (2013.01)

(58) Field of Classification Search
USPC ..... 250/305, 281, 282, 285, 288
See application file for complete search history.

(56) References Cited

U.S. PATENT DOCUMENTS

| | | | |
|---|---|---|---|
| 2007/0015158 | A1 | 1/2007 | McLuckey et al. |
| 2007/0057176 | A1 | 3/2007 | Grossenbacher et al. |
| 2014/0048701 | A1 | 2/2014 | Green et al. |

OTHER PUBLICATIONS

International Search Report and Written Opinion from the International Searching Authority for International Application No. PCT/US2016/024757, dated Jun. 20, 2016. (9 pages).

* cited by examiner

APPARATUS FOR MASS ANALYSIS OF ANALYTES BY SIMULTANEOUS POSITIVE AND NEGATIVE IONIZATION

CROSS REFERENCE TO RELATED APPLICATIONS

This application is a continuation of U.S. patent application Ser. No. 15/560,386 filed Sep. 21, 2017, which claims priority to PCT Application PCT/US2016/24757 filed Mar. 29, 2016, and claims the benefit of priority to U.S. Provisional Application 62/139,758, titled "Detecting Chemical Compounds" filed on Mar. 29, 2015, the entire contents of all of which are incorporated herein by reference.

TECHNICAL FIELD

The present invention is directed to methods of and apparatus for ionization for mass analysis of molecules.

BACKGROUND

Mass spectrometers (MS) are widely used in the field of analytical chemistry for the analysis of compounds in liquids and gasses and the study of reaction mechanisms. MS are often coupled with gas chromatographs (GC) for the analysis of complex mixtures of unknown chemicals and/or the quantification of known chemicals. Such instruments have been used extensively in forensic and environmental studies.

SUMMARY OF THE INVENTION

Methods and apparatus for the ionization of target molecular analytes of interest, e.g., for use in mass spectrometry. In some implementations, a thin molecular stream is emitted in either single or a split mode and encounters both an electron-impact ion source and trochoidal electron monochromator placed sequentially or coincidentally. The first ion source emits high-energy electrons (~70 eV) to generate characteristic positively-charged mass fragment spectra while the second source emits low-energy electrons in a narrow bandwidth to generate negative molecular ions or other ions via electron capture ionization. The dual ion source may be coupled to analytical instruments such as a gas chromatograph and to any number of mass analyzers such as a polarity switching quadrupole mass analyzer or to multiple mass analyzers.

The technology described herein has a number of advantages. For example, the identity of a target molecule may be determined with greater confidence because positive EI mass fragment spectra of analytes are produced simultaneously with negative TEM mass spectra. While many analytes do not produce a molecular cation by EI ionization, the molecular anion may be produced from the TEM ion source. Depending on the configuration (e.g., single ionization chamber) and method of mass analysis (e.g., electrostatic deflector), these dual mass spectra may be obtained with minimal losses in sensitivity, while offering greatly enhanced data granularity and selectivity.

Other features and advantages of the present inventive concept should be apparent from the following description which illustrates by way of example aspects of the present inventive concept.

BRIEF DESCRIPTION OF FIGURES

Aspects and features of the present inventive concept will be more apparent by describing example embodiments with reference to the accompanying drawings.

DETAILED DESCRIPTION

Figure 1A:
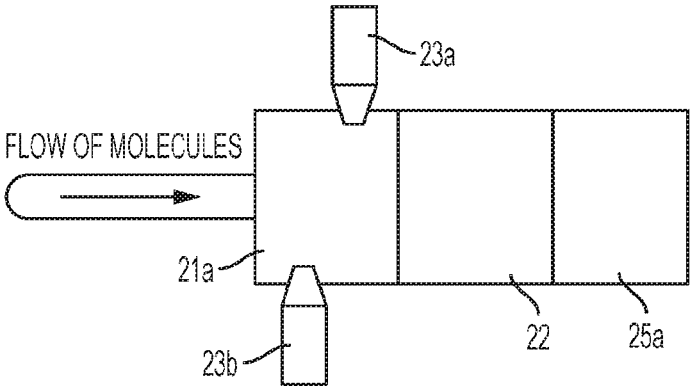
FIG. 1A shows a schematic for a dual ion system in which two ion sources target the same ionization chamber.

While certain implementations are described, these embodiments are presented by way of example only, and are not intended to limit the scope of protection. The apparatuses, methods, and systems described herein may be embodied in a variety of other forms. Furthermore, various omissions, substitutions, and changes in the form of the example methods and systems described herein may be made without departing from the scope of protection.

Disclosed is an apparatus for the ionization of target molecular analytes. In some implementations, a thin molecular stream is emitted in either single or a split mode and encounters both an electron-impact ion source and a trochoidal electron monochromator placed sequentially or coincidentally. The first ion source emits high-energy electrons (~70 eV) to generate characteristic positively-charged mass fragment spectra while the second source emits low-energy electrons in a narrow bandwidth to generate negative molecular ions or other ions via electron capture ionization. The dual ion source may be coupled to analytical instruments such as a gas chromatograph and to any number of mass analyzers such as a polarity switching quadrupole mass analyzer or to an electrostatic deflector combined with multiple mass analyzers.

In various implementations, an apparatus for the ionization of target molecular analytes may include an electron-impact ion source configured to emit positively-charged molecular ions and fragment ions and operate at 70 eV with a bandspread of 1-2 eV, a trochoidal electron monochromator configured to emit negatively-charged molecular ions and fragment ions and operate between 0 to 10 eV, and configured for a bandwidth of +/−0.1 eV, a first set of collimating electrodes arranged along a path of an electron beam of the electron-impact ion source, and a second set of collimating electrodes arranged along a path of an electron beam of the trochoidal electron monochromator. The trochoidal electron monochromator may include an electron deflecting region defined by the path of the electron beam of the trochoidal electron monochromator, in which electrons enter the electron deflecting region at a point that may be offset from their outlet due to the trochoidal motion of electrons. The apparatus may further include at least one ionization chamber having inlets for at least one of the electron beams and a gaseous molecular stream, the at least one ionization chamber including an ion repeller plate and configured to emit ions along an output path, two sets of electron collectors and electron target plates, both sets arranged along the path of a respective electron beam of the electron beams. The distance between the electron beams may be adjustable. The apparatus may also include at least one mass analyzer and ion target plate capable of both positive and negative ion acquisition.

In various implementations, methods of ionization for use in a mass spectrometer may include generating two electron beams using two ion sources. The ion sources may include (a) a first ion source comprising a 70 eV ion source with a bandspread of 1-2 eV for electron-impact ionization of a subpopulation of sample molecules, and (b) a second ion source operated between 0-12 eV with a bandspread of <0.1 eV for electron-capture ionization of a subpopulation of sample molecules. The method may further include directing the flow of sample molecules to the two ion sources as either a single molecular stream to an ionization chamber or as a split flow between two ionization chambers, and performing mass analysis of ions in the two electron beams generated by the two ion sources in a quantitative or qualitative determination of analytes, including generating positive and negative mass spectra.

Various implementations may include, systems for splitting the flow of gaseous molecules, in which the systems may include a first ionization chamber containing a first ion source comprising an electron gun for electron-impact ionization of molecules, and a second ionization chamber containing a second ion source comprising a trochoidal electron monochromator for electron-capture ionization of molecules. The split ratio of molecules between the first ion source and the second ion source may be tuned to meet the requirements of an individual analysis.

In some implementations s, the system introduces two electron beams into one or two separate ionization chambers; one beam comes from an EI source and the other from a TEM source. To emit electrons, a current is passed through a filament in each source. While the average energy of these electrons may be adjusted by tuning the filament potential, the electrons possess a broad range of kinetic energies.

One frequently-used ion source is a "hard" electron-impact (EI) ionization source. These sources typically operate by bombarding a thin stream of gas-phase molecules at 70 eV using a hot filament inside a vacuum of $10^{-5}$ to $10^{-6}$ Torr. Electrons are magnetically drawn from the filament and focused into a narrow beam with a bandwidth of +/−1-2 eV. This beam passes through an ionization chamber where electrons collide with target molecules. Upon collision with a high-energy electron, a target molecule fragments into characteristic positive ions with different m/z ratios, known as a fragmentation pattern. Ionization of the molecule (AB) occurs generally via the following reaction pathway:

$$AB+e^{-}_{filament}\rightarrow AB^{+}+e^{-}_{molecule}+e^{-}_{filament}$$

$$AB^{+}\rightarrow A^{+}+B$$

These fragmentation patterns may be compared to literature mass spectra for identification of unknown compounds or used to quantify target compounds based on the amount of ion current observed. Many quantitative gas chromatography/mass spectrometry methods rely on EI ionization.

While EI ionization has a well-established ability to produce quantitative data, it possesses shortcomings. According to the National Institute of Standards and Technology, approximately ⅓rd of all compounds will lose their molecular ion under standard EI conditions. The molecular ion is useful because it provides the greatest information regarding compound identity. An ideal ion source will produce quantitative, sensitive data that can be compared to literature spectra whilst still preserving the molecular ion.

Electron capture (EC) negative ion mass spectrometry is an alternative ionization mechanism that may result in more limited or even near-zero fragmentation of the parent molecule. Unlike EI ionization, the electrons in EC ionization possess a low energy. Rather than positively-charged fragment ions, these sources predominantly produce negatively-charged molecular ions (M−). Molecular ions minus hydrogen (M-H—), and additional fragments may also be generated via the following reaction pathways:

$$AB+e^{-}_{filament}\rightarrow AB-$$

$$ABH+e^{-}_{filament}\rightarrow AB-+H$$

$$AB+e^{-}_{filament}\rightarrow A-+B$$

Trochoidal electron monochromators (TEM) may be used as a "soft" negative ionization source. TEM ionization is similar to EI in that a narrow band of molecules are ionized by an incident beam of electrons. Generally, TEM electrons are monochromatic. Since electron capture resonances may require voltages below 1 eV, the bandwidth of TEM is less than +/−0.1 eV. The ability to tune this narrow bandwidth of electrons between ~0 and 10 eV allows selective ionization of particular sample components, adding selectivity and simplifying mass spectra when combined with a mass analyzer. In some implementations, scanning the TEM source potential enables multiple different ions to be generated from an analyte.

Hard ionization may be combined with sources that can preserve the molecular ion (e.g. chemical ionization) into a single instrument. While simultaneously generating molecular ions and fragmentation patterns for target molecules, these instruments sometimes have low MS acquisition rates or additive ion signals from both sources that can complicate library identification of unknowns.

This description details the combination of an EI ionization source with a TEM as an EC ionization source. In the examples that utilize a single ionization chamber, the sources target a molecular beam at either a single point or two different points. However, target molecules may also be split between two separate sources. The sources may be configured using a single ionization chamber or two ionization chambers, depending on whether the molecular stream is in a split mode. This setup generates two non-interfering mass spectra, as one source generates positive ions and the other source generates negative ions. The positive-ion fragmentation pattern may be used for quantification and library identification of sample components while the negative-ion spectrum may contribute to forming the molecular ion.

Thus, an ion source is described herein for the simultaneous positive and negative ionization of analytes introduced to a mass spectrometer. While the positive ion source is typically tuned to 70 eV, the negative ion source may be tuned to emit desired anions, such as the molecular ion. The dual ion source may be coupled with any type and number of mass analyzers capable of both positive and negative ion acquisition. These techniques may be used to qualitatively and/or quantitatively analyze target compounds, identify unknown compounds, study chemical reactions or for any use requiring highly-accurate and selective mass analysis.

In some implementations, the positive ion source is a standard electron-impact ion source capable of producing a wide range of potentials with a large bandwidth of several eV. In some implementations, the second ion source is a trochoidal electron monochromator operated between ~0 to 10 eV with a narrow bandwidth of +/−0.1 eV. The dual ion sources may be placed incidental or parallel to one another along the flow path of the molecular beam so that both positive and negative spectra are generated at once.

In modern mass spectrometers, EI sources typically utilize a series of collimating lenses to focus incident electrons into a narrow beam with a bandwidth of ~1-2 eV. These sources are typically operated at 70 eV in order to generate invariant mass fragmentation as the ionization cross sections of molecules are generally at a maximum at this potential.

In some implementations, the TEM source is operated at lower energies, and may be tunable in order to better achieve frequencies that are resonant with the electron capture ionization of target analytes. The low-energy electrons that it produces may be confined through a series of collimating lenses and sent through orthogonal electric and magnetic fields. The crossed electric and magnetic fields produce trochoidal motion of electrons as they pass through, which describes the movement of a fixed point on a circle as it rolls. Since electrons with different energies are deflected differently, in typical scenarios electrons possessing a narrow energy spread of >0.1 eV are emitted.

Figure 1B:
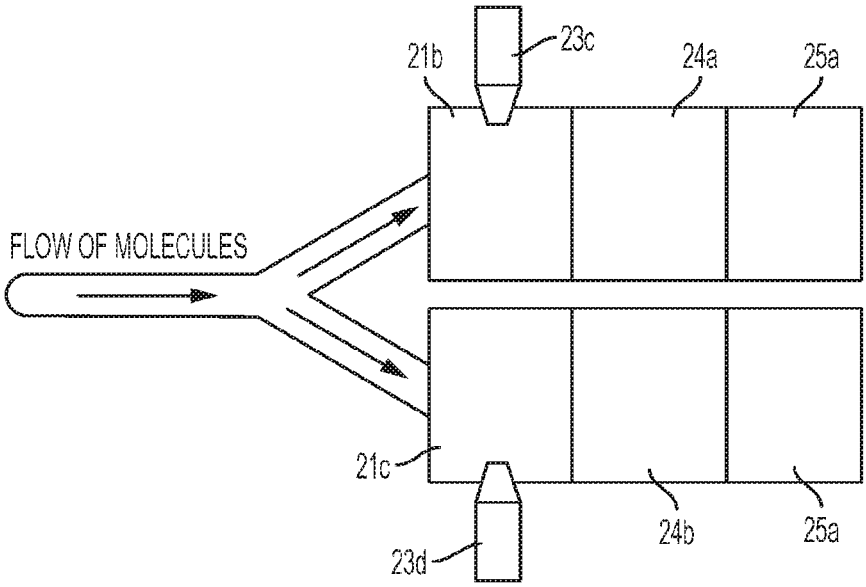
FIG. 1B show a schematic for a dual ion system in which a split flow is applied between two ionization chambers.

FIG. 1A and FIG. 1B show schematics for the dual ion system. In FIG. 1A, both ion sources target the same ionization chamber. In FIG. 1B, a split flow is applied between two ionization chambers. Two approaches to the dual ion source are depicted. FIG. 1A shows a configuration in which EI and TEM sources 23*a-b* are positioned around a single ionization chamber 21*a*. Positive and negative ions are drawn either into mass analyzer 22 which is capable of measuring ions of opposite charge. This may be an electrostatic deflector that separates ions of opposite charge before mass analysis. FIG. 1B shows a configuration in which the molecular stream is split between two ionization chambers 21*b-c* and mass analyzers 24*a-b*. One chamber contains the EI source 23*c* while the other contains the TEM source 23*d*. In some implementations, this design results in a decrease in sensitivity for each detector proportional to the split ratio of the molecular stream. In some implementations, the mass analyzers shown in FIG. 1A and FIG. 1B each include one or more detectors 25*a-c*.

Figures 2A, 2B:
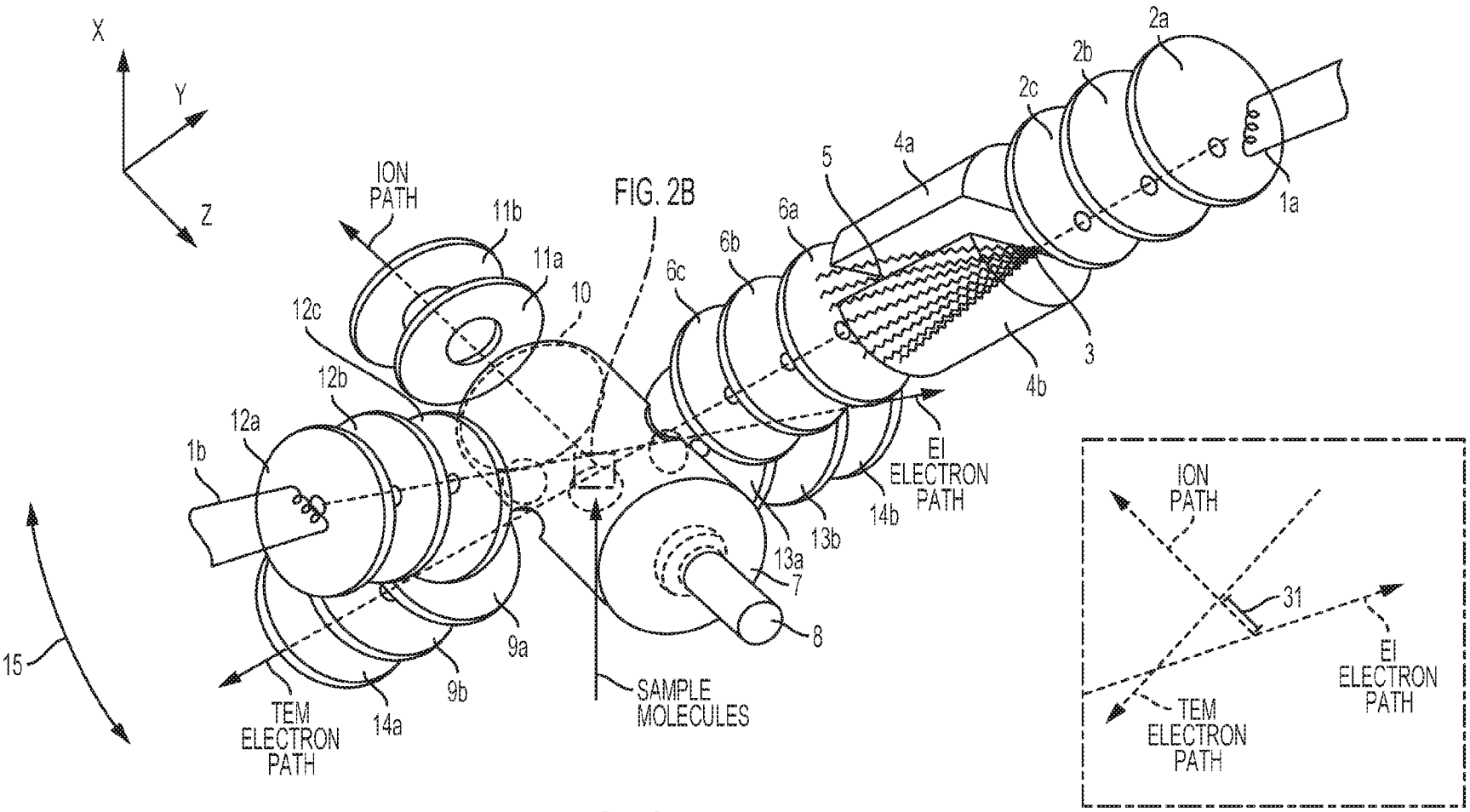
FIG. 2A shows the EI/TEM dual ion source system in isometric projection.
FIG. 2B shows spacing of ionization source paths.

FIG. 2A shows the EI/TEM dual ion source system in isometric projection, e.g., coupled with a single ionization chamber. Shown are two filaments 1*a*, 1*b* for the TEM and EI sources, collimating electrodes 2*a-c*, 12*a-c*, electron deflecting region 4*a-b*, second set of collimating electrodes 6*a-c*, ionization chamber with inlets for the electron beams and gaseous molecular stream 7, ion repeller plate 8, final sets of electron collimating lenses/electron collectors 9*a-b*, 13*a-b*, electron target plates 14*a-b*. TEM electrons enter the deflection region at a point 3 that may be offset from their outlet due to the trochoidal motion of electrons 5. A variable angle 15 is present such that the half angle is parallel to axis Y, and in some implementations is adjustable. Ionization chamber exit 10 and ion extraction optics 11*a-c* are shown that are separate from the dual ion source and may be used for focusing both positive and negative ions downstream into a mass analyzer. Spacing of ionization source paths are shown in FIG. 2B. The distance between electron beams may be adjusted along axis Z at distance 31. The EI and TEM sources can also be operated in the alternating mode, in which the two beams to not reach the ionization chamber simultaneously, but cycle rapidly to produce positive and negative ions sequentially. The ion source may be contained within a metal housing (not shown) designed to withstand vacuums reaching or surpassing $10^{-6}$ torr.

When a single ionization chamber is used, gas-phase molecules first encounter incident electrons from the EI source, producing positively-charged molecular and/or fragment ions. After a distance 31, the remaining gas-phase molecules pass through the TEM source, further generating negatively-charged ions via electron capture. Ions are collimated along axis Z and analyzed, e.g., using any mass analyzer capable of simultaneous detection of positive and negative ions. While the ionization chamber is depicted with the EI source first and the TEM source second, the order of ionization chambers may be changed depending on the scope of analysis.

Figure 3:
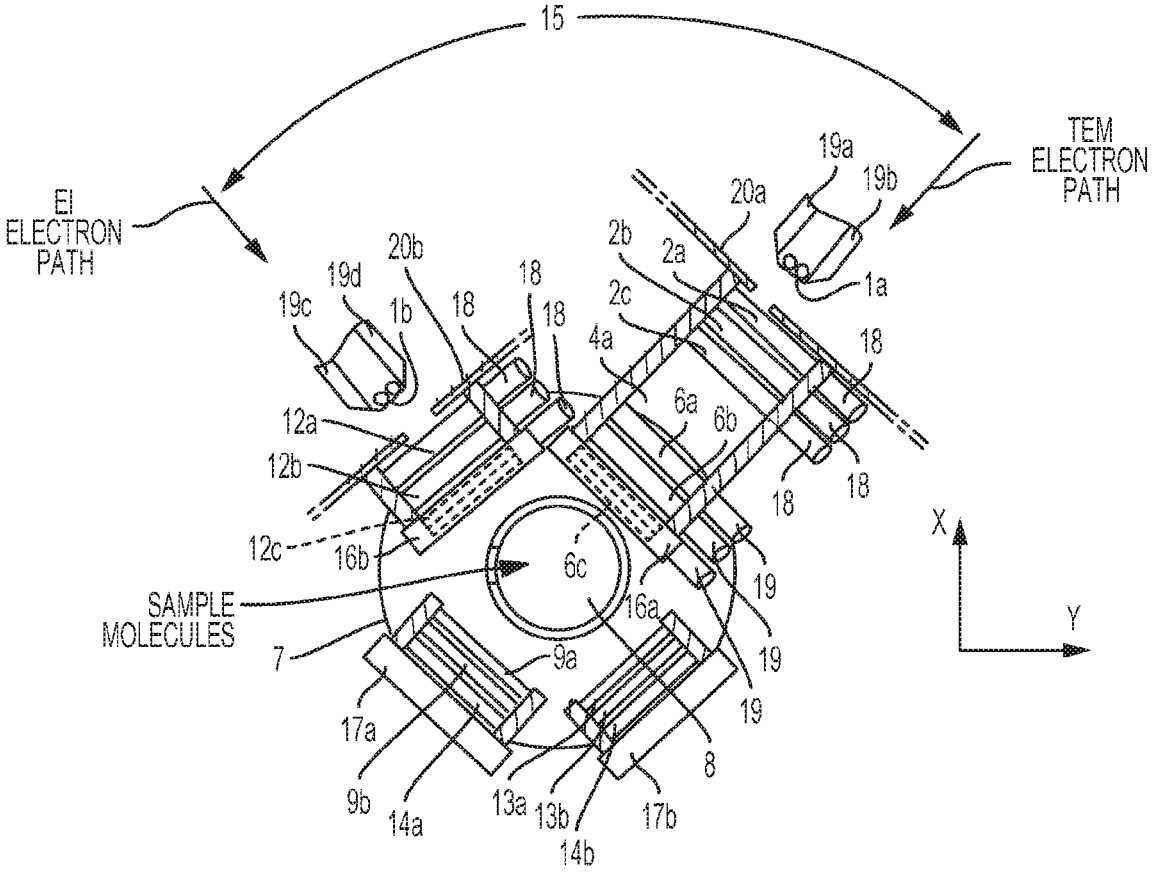
FIG. 3 shows a cutaway of the dual ion source.

FIG. 3 shows a cross-section of the dual ion source having a single ionization chamber. The filaments, deflection region and ionization chamber are contained within housings that are mounted together. In this design, EI and TEM ion sources are placed orthogonally at angle 15 along an axis point at the center of the ionization chamber 7. Other configurations may be used, e.g. parallel ion sources. Filaments 1*a*, 1*b* are held by supports 19*a-d* and electrons are emitted through cover plates 20*a-b*. Entrance electrodes 2*a-c* are charged via electrical leads 18 and emit electrons into the deflection region of the TEM. Electrodes 6*a-c* held in by a mating sleeve 16*a* further collimate electrons and emit them into the ionization chamber. The terminus of the TEM includes collimating lenses 9*a-b*, target plate 14*a* and endplate 17*a*.

The EI source emits electrons through a cover plate 20*b* and focusing lenses 12*a-c*. The ion source connects to the ionization chamber via mating sleeve 16*b*. The EI terminus contains final electrodes 13*a-b*, target plate 14*b* and endplate 17*b*.

In some implementations, the dual ion source system is coupled to any number of types of mass analyzers including, but not limited to, ion trap, quadrupole, triple quadrupole, ion-cyclotron, magnetic sector, or Fourier-transform apparatuses. In the configuration shown in FIG. 1A, a mass analyzer is used that is capable of analyzing both positive and negative ions simultaneously. One example of mass analyzer capable of this acquisition mode is a polarity-switching quadrupole. Alternately, an electrostatic deflector may separate ions of positive and negative charge into separate beams. Electrostatic deflectors have been coupled with two mass analyzers for the simultaneous detection of positive and negative ions without the need for polarity switching, which may lose data granularity.

In some implementations, the instrument controlling the ion source described herein is in communication with a computer terminal having appropriate data acquisition/analysis software to convert information from the mass spectrometer into an output that may be interpreted by the analyst.

Figure 4:
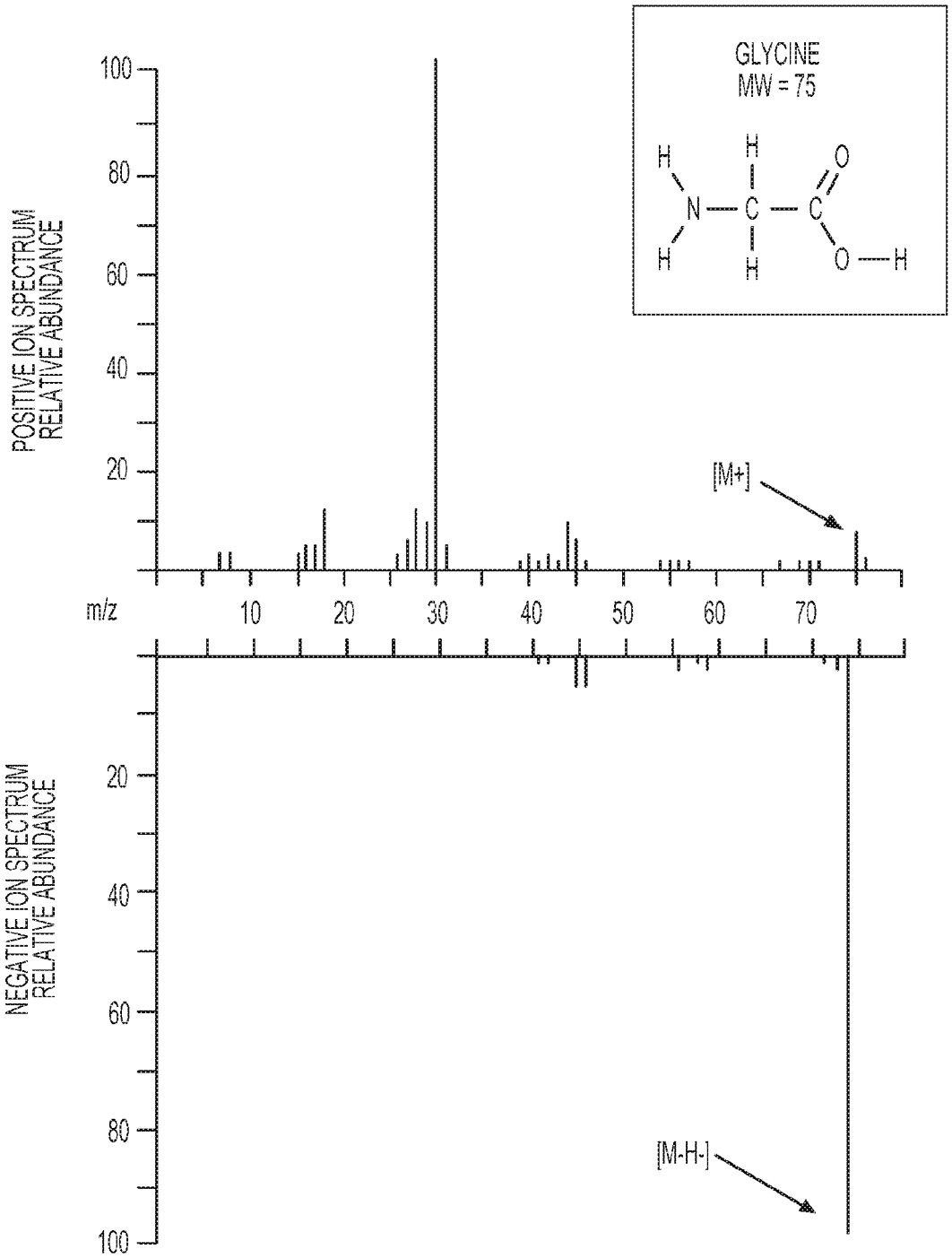
FIG. 4 shows output of both positive electron impact and negative electron capture mass spectra.

FIG. 4 uses the mass spectra of the amino acid glycene to depict the potential output of the dual ion source system. The positive EI mass spectrum of glycene (top) is shown. This molecule emits the molecular ion (Mt) at below 10% relative abundance, which is often difficult to distinguish from the noise in complex samples. In fact, an estimated 30% of molecules fail to emit a molecular ion at all when ionized by sources operated at 70 eV. The TEM mass spectrum (bottom) of glycene between 1-12 eV is also shown. Unlike the electron-impact mass spectrum, there is far less fragmentation of glycene. This has the effect of making the $M\text{-}H^-$ ion the base ion in the spectrum. The acquisition of the positive EI spectrum and $M\text{-}H^-$ ion may assist in compound identification and/or the characterization of complex mixtures and in forensic studies.

The electrodes described herein may be made of various metals and alloys including, but not limited to tungsten, stainless steel, tantalum and molybdenum.

Many other implementations other than those described here may be used, and any such implementations may be covered by the following claims. Although the present disclosure provides certain example embodiments and applications, other embodiments that are apparent to those of ordinary skill in the art, including embodiments which do not provide all of the features and advantages set forth herein, are also within the scope of this disclosure. Accordingly, the scope of the present disclosure is intended to be defined only by reference to the appended claims.

The invention claimed is:

1. An apparatus for ionizing target molecular analytes, comprising:

a first ion source comprising an electron beam, the first ion source configured to emit positively-charged molecular ions and fragment ions and operate at approximately 70 eV;

a second ion source comprising an electron beam, the second ion source configured to emit negatively-charged molecular ions and fragment ions and operate at between 0 to 10 eV;

wherein the second ion source is tunable in order to better achieve frequencies that are resonant with electron capture ionization of target analytes, and wherein the second ion source comprises an electron deflecting region defined by a path of the election beam of the second ion source, wherein electrons enter the electron deflection region at a point that can be offset from their outlet due to motion of electrons;

a first set of collimating electrodes arranged along a path of the electron beam of the first ion source;

a second set of collimating electrodes arranged along a path of the electron beam of the second ion source;

a first set of electron collectors and electron target plates arranged along the path of the electron beam of the first ion source;

a second set of electron collectors and electron target plates arranged along the path of the electron beam of the second ion source;

a first ionization chamber comprising an inlet for the electron beam of the first ion source, the first ionization chamber configured to emit ions along an output path for ions from the first ion source;

a second ionization chamber comprising an inlet for the electron beam of the second ion source, the second ionization chamber configured to emit ions along an output path for ions from the second ion source;

a first mass analyzer configured to analyze ions from the first ion source; and a second mass analyzer configured to analyze ions from the second ion source;

wherein a split ratio of molecules between the first ion source and the second ion source can be tuned to meet requirements of an individual analysis.

2. The apparatus of claim 1, wherein an electrostatic deflector separates ions of opposite charge before mass analysis by the mass analyzer, enabling simultaneous detection of positive and negative ions without polarity switching.

3. The apparatus of claim 1, wherein at least either the first mass analyzer or the second mass analyzer comprises a polarity-switching quadrupole.

4. The apparatus of claim 1, wherein the apparatus is configured for simultaneous ionization of compounds by their characteristic positive-ion mass fragment spectrum from the first ion source and by their negative-ion mass spectrum from the second ion source.

5. The apparatus of claim 1, wherein the second ion source is configured to be tuned to generate molecular anions of incident molecules.

6. The apparatus of claim 1, wherein the second ion source is configured to be tuned to generate characteristic fragment ions of incident molecules.

7. The apparatus of claim 1, wherein gas-phase molecules encounter incident electrons from the first ion source, producing positively-charged molecular ions and/or fragment ions, and gas-phase molecules pass through the second ion source, generating negatively-charged ions via electron capture.

8. An apparatus for ionizing target molecular analytes comprising:

a first ion source comprising an electron beam, the first ion source configured to emit positively-charged molecular ions and fragment ions and operate at approximately 70 eV;

a second ion source comprising an electron beam, the second ion source configured to emit negatively-charged molecular ions and fragment ions and operate at between 0 to 10 eV, wherein the second ion source is tunable in order to better achieve frequencies that are resonant with electron capture ionization of target analytes, and wherein the second ion source comprises an electron deflecting region defined by a path of the election beam of the second ion source, wherein electrons enter the electron deflection region at a point that can be offset from their outlet due to motion of electrons;

a first set of collimating electrodes arranged along a path of the electron beam of the first ion source;

a second set of collimating electrodes arranged along a path of the electron beam of the second ion source;

a first set of electron collectors and electron target plates arranged along the path of the electron beam of the first ion source;

a second set of electron collectors and electron target plates arranged along the path of the electron beam of the second ion source;

a single ionization chamber comprising a first inlet for the electron beam of the first ion source and a second inlet for the electron beam of the second ion source, the single ionization chamber configured to emit ions along an output path for ions from the first ion source and the second ion source;

a mass analyzer configured to analyze ions from the first ion source and the second ion source; and wherein a split ratio of molecules between the first ion source and the second ion source can be tuned to meet requirements of an individual analysis.

9. The apparatus of claim 8, configured for simultaneous ionization of compounds by their characteristic positive-ion mass fragment spectrum from the first ion source and by their negative-ion mass spectrum from the second ion source.

10. The apparatus of claim 8, wherein the second ion source is configured to be tuned to generate molecular anions of incident molecules.

11. The apparatus of claim 8, wherein the second ion source is configured to be tuned to generate characteristic fragment ions of incident molecules.

12. An apparatus for ionizing target molecular analytes comprising:

a first ion source comprising an electron beam, the first ion source configured to emit positively-charged molecular ions and fragment ions and operate at approximately 70 eV;

a second ion source comprising an electron beam, the second ion source configured to emit negatively-charged molecular ions and fragment ions and operate at between 0 to 10 eV, wherein the second ion source is tunable in order to better achieve frequencies that are resonant with electron capture ionization of target analytes, and wherein the second ion source comprises an electron deflecting region defined by a path of the election beam of the second ion source, wherein electrons enter the electron deflection region at a point that can be offset from their outlet due to motion of electrons;

a first ionization chamber comprising an inlet for the electron beam of the first ion source, the first ionization chamber configured to emit ions along an output path for ions from the first ion source;

a second ionization chamber comprising an inlet for the electron beam of the second ion source, the second ionization chamber configured to emit ions along an output path for ions from the second ion source;

a first mass analyzer configured to analyze ions from the first ion source; and a second mass analyzer configured to analyze ions from the second ion source;

wherein a split ratio of molecules between the first ion source and the second ion source can be tuned to meet requirements of an individual analysis;

wherein gas-phase molecules encounter incident electrons from the first ion source, producing positively-charged molecular ions and/or fragment ions, and gas-phase molecules pass through the second ion source, generating negatively-charged ions; and wherein the apparatus is configured for simultaneous ionization of compounds by their characteristic positive-ion mass fragment spectrum from the first ion source and by their negative-ion mass spectrum from the second ion source.

13. The apparatus of claim 12, further comprising an electrostatic deflector configured to separate ions of opposite charge before mass analysis by the mass analyzers, enabling simultaneous detection of positive and negative ions without the need for polarity switching.

14. The apparatus of claim 12, wherein the mass analyzers comprise a polarity-switching quadrupole.

15. The apparatus of claim 12, wherein gas-phase molecules encounter incident electrons from the first ion source, producing positively-charged molecular ions and/or fragment ions, and gas-phase molecules pass through the second ion source, generating negatively-charged ions via electron capture.

* * * * *